US008534815B2

(12) United States Patent
Watanabe

(10) Patent No.: US 8,534,815 B2
(45) Date of Patent: Sep. 17, 2013

(54) FLOW PATH MEMBER, LIQUID EJECTING HEAD, AND LIQUID EJECTING APPARATUS

(75) Inventor: Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 12 days.

(21) Appl. No.: 13/332,174

(22) Filed: Dec. 20, 2011

(65) Prior Publication Data

US 2012/0182363 A1 Jul. 19, 2012

(30) Foreign Application Priority Data

Jan. 14, 2011 (JP) ..... 2011-006492

(51) Int. Cl.
*B41J 2/175* (2006.01)

(52) U.S. Cl.
USPC ..... 347/86; 347/85

(58) Field of Classification Search
USPC ..... 347/84, 85, 86, 87
See application file for complete search history.

(56) References Cited

U.S. PATENT DOCUMENTS

| | | | | | |
|---|---|---|---|---|---|
| 4,700,202 | A * | 10/1987 | Kuranishi et al. | ..... | 347/86 |
| 5,126,767 | A * | 6/1992 | Asai | ..... | 347/86 |
| 6,132,036 | A * | 10/2000 | Abe et al. | ..... | 347/86 |
| 6,540,342 | B2 * | 4/2003 | Koshikawa et al. | ..... | 347/86 |
| 6,712,458 | B2 * | 3/2004 | Hatasa et al. | ..... | 347/86 |
| 6,877,848 | B2 * | 4/2005 | Shimizu et al. | ..... | 347/86 |

FOREIGN PATENT DOCUMENTS

| | | |
|---|---|---|
| JP | 10296989 | * 11/1998 |
| JP | 2000-218781 | 8/2000 |
| JP | 2009119801 | * 11/2007 |

* cited by examiner

*Primary Examiner* — Anh T. N. Vo
(74) *Attorney, Agent, or Firm* — Workman Nydegger

(57) ABSTRACT

A seal member is held in tight contact with a first inner wall of a first opening of a flow-in path section (ink inlet hole) by a fixing member. An ink supply pipe is urged and held into a holding hole of the seal member, so that the ink supply pipe is held in a predetermined position with respect to the first inner wall of the first opening of the ink inlet hole and a second inner wall of a second opening of the ink inlet hole. As a result, the ink supply pipe is held in the ink inlet hole with the first opening of the ink inlet hole being kept airtight.

13 Claims, 3 Drawing Sheets

FLOW PATH MEMBER, LIQUID EJECTING HEAD, AND LIQUID EJECTING APPARATUS

This application claims a priority to Japanese Patent Application No. 2011-006492 filed on Jan. 14, 2011 which is hereby expressly incorporated by reference herein in its entirety.

BACKGROUND

1. Technical Field

The present invention relates to a flow path member, a liquid ejecting head, and a liquid ejecting apparatus.

2. Related Art

An ink jet recording head (liquid ejecting head: ink ejecting head) that ejects ink droplets from a nozzle opening using pressure generated by displacement of a piezoelectric element, for example, is known as a typical example of a liquid ejecting head. The ink ejecting head which has been known is supplied with ink from a fluid source of ink (ink cartridge), and ejects the supplied ink from nozzles by driving a pressure generating unit, such as a piezoelectric element or heat generating element.

An ink flow path extending from the ink cartridge is connected to the ink ejecting head, and a seal member like a rubber member is provided at the connected portion between the ink ejecting head and the ink cartridge (see, for example, JP-A-2000-218781). Sealing the connected portion between the ink ejecting head with a rubber member can prevent the ink from leaking at the connected portion with positional misalignment between the ink ejecting head and the ink cartridge being absorbed.

There is an ink ejecting unit constructed to have an ink ejecting head with a valve body which is opened and closed in accordance with the pressure state of a flow path on the ink ejecting head side. The valve body is provided in the flow path to supply ink to the ink ejecting head from the ink cartridge. When ink is ejected from the ink ejecting head in such an ink ejecting unit, the flow path on the ink ejecting head side has negative pressure, causing the valve body to open to supply the ink.

In the ink ejecting unit having the valve body which is opened and closed in accordance with the pressure state of the flow path on the ink ejecting head side, pressures in the flow path on the ink ejecting head side and the flow path on the ink cartridge side relatively vary at the connected portion between the ink ejecting head and the ink cartridge. This is likely to affect the seal member at the connected portion between the ink ejecting head the ink cartridge, and therefore the rigidity of the seal member may be enhanced to prevent ink leakage therefrom.

SUMMARY

An advantage of some aspects of the invention is to provide a flow path member capable of keeping airtightness of the members to be connected together with a simplified structure, regardless of a variation in pressure in the flow path or the like.

Another advantage of some aspects of the invention is to provide a liquid ejecting head and a liquid ejecting apparatus each of which includes a flow path member capable of keeping airtightness of the members to be connected together with a simplified structure, regardless of a variation in pressure in the flow path or the like.

According to an aspect of the invention, there is provided a flow path member including, an elastic urging member that urges and holds a fluid supply pipe having a supply path that supplies a fluid downstream, a holder having a first inner wall that defines a first opening and on which an outer wall of the elastic urging member abuts and a second inner wall that defines a second opening smaller than the first opening, the fluid supply pipe being disposed inward of the first inner wall and the second inner wall with the outer wall of the elastic urging member held against the first inner wall, and a fixing member that abuts on an inner wall of the elastic urging member to hold the elastic urging member between the fixing member and the first inner wall of the holder.

Accordingly, the elastic urging member is in tight contact with the first inner wall of the first opening of the holder (e.g., resin holder) by the fixing member. As a result, the fluid supply pipe is urged and held on the inner wall of the elastic urging member and is held in a predetermined position with respect to the first inner wall of the first opening and the second inner wall of the second opening of the holder, and the fluid supply pipe is held on the holder with the first opening of the holder kept airtight. Even when the pressure on the upstream side of the fluid supply pipe and the pressure on the second opening side of the holder vary relatively, i.e., regardless of a variation in pressure in the flow path or the like, the airtightness of the members which are connected together can be maintained.

It is preferable that a clearance be provided between a portion of the fixing member that holds the elastic urging member at the first opening, and the fluid supply pipe.

Accordingly, the first opening that defines the first inner wall is formed in such a way as to provide a clearance between the fixing member and the fluid supply pipe, so that urging and holding of the fluid supply pipe with the elastic urging member can be surely maintained without the interference of the fixing member with the fluid supply pipe.

It is preferable that the elastic urging member should include a holding section that holds the fluid supply pipe, and an edge portion formed contiguous to the holding section with a clearance provided between the edge portion and the fluid supply pipe held by the holding section, and the fixing member should abut on an inner wall of the edge portion to hold the elastic urging member between the fixing member and the first inner wall of the holder.

This structure allows the fluid supply pipe to be held on the holding section of the elastic urging member, and the fixing member causes the edge portion of the elastic urging member to be in tight contact with the first inner wall, so that the sealing of the first opening can be maintained with the fluid supply pipe held, without increasing the rigidity of the elastic urging member.

It is preferable that a liquid supplied from the fluid supply pipe urged and held by the elastic urging member should be supplied to a head body, and the head body should be provided with an opening/closing member that opens and closes a flow path between the head body and the second opening in accordance with pressure in a flow path in the head body.

Accordingly, even when the pressure on the second opening side of the holder varies according to the open/closed state of the opening/closing member, the tight contact of the edge portion of the elastic urging member with the first inner wall by the fixing member is maintained. Even when the opening/closing member that opens and closes the flow path between the head body and the second opening in accordance with pressure in the flow path in the head body is provided, the airtightness of the members which are connected together can be maintained.

It is preferable that the elastic urging member and the fixing member be formed integrally. For example, preferably, the elastic urging member and the fixing member are formed integrally to be a composite member through coinjection molding.

Accordingly, when the composite member of the elastic urging member and the fixing member is welded to the holder at the upper side portion of the first opening, the elastic urging member can be attached to the holder. Through only the step of attaching the composite member (single step), the elastic urging member is pressed against the first inner wall and in tight contact therewith by the fixing member while being disposed inward of the first inner wall of the holder.

According to another aspect of the invention, there is provided a liquid ejecting head including the aforementioned flow path member, and a head body connected to a downstream side of the holder of the flow path member and having a nozzle opening.

This structure provides a liquid ejecting head which includes a flow path member capable of keeping airtightness of the members to be connected together with a simplified structure, regardless of a variation in pressure in the flow path or the like.

According to a further aspect of the invention, there is provided a liquid ejecting apparatus including the aforementioned liquid ejecting head, and a fluid source connected to an upstream side of the fluid supply pipe held by the elastic urging member of the flow path member.

This structure provides a liquid ejecting apparatus which includes a flow path member capable of keeping airtightness of the members to be connected together with a simplified structure, regardless of a variation in pressure in the flow path or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
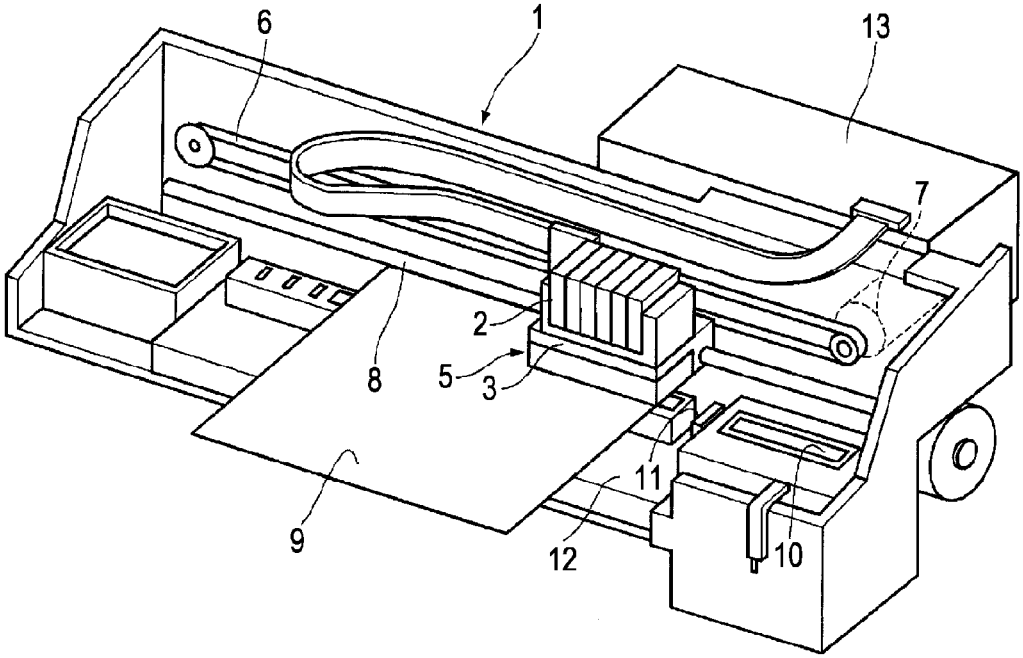
FIG. 1 is a schematic diagram of an ink jet recording apparatus.
Figure 2:
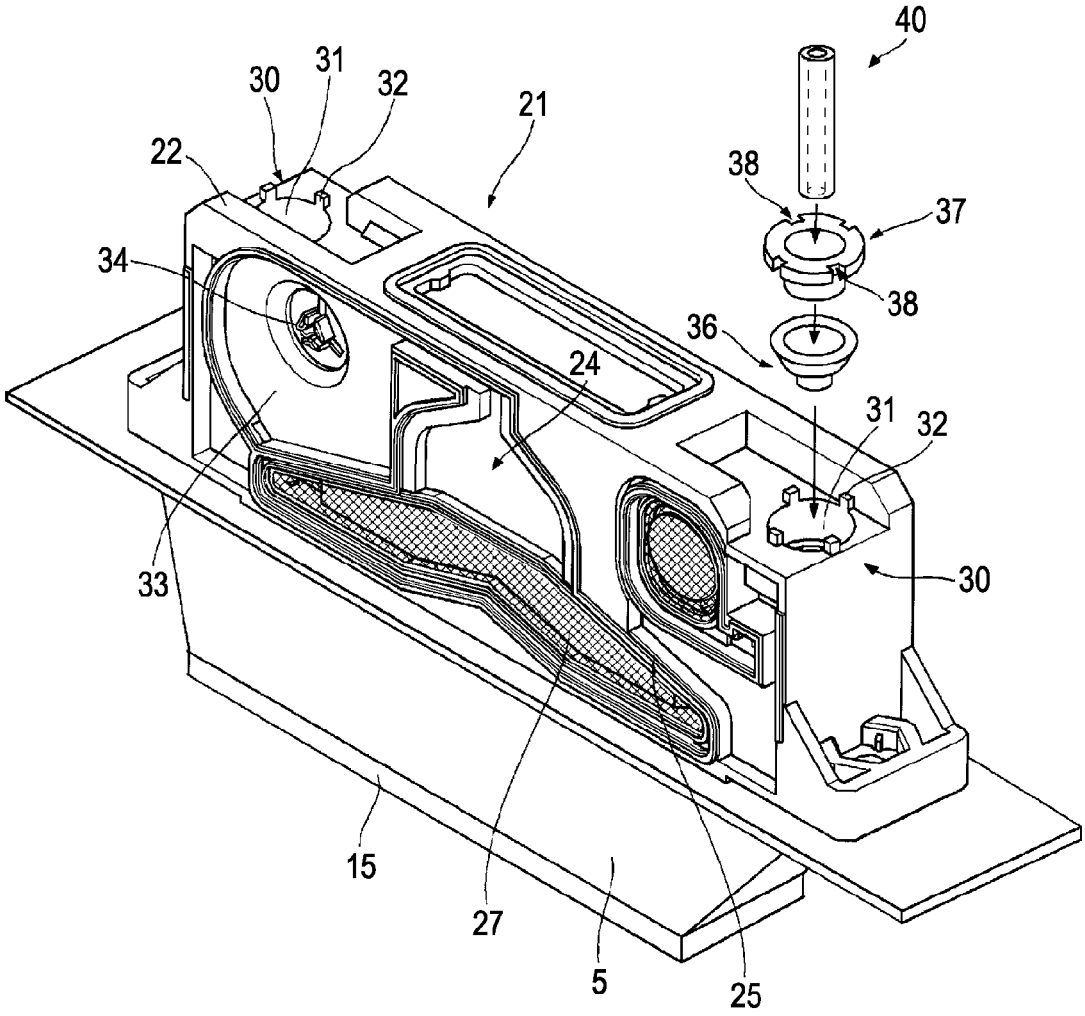
FIG. 2 is a perspective view of an ink ejecting head.
Figure 3:
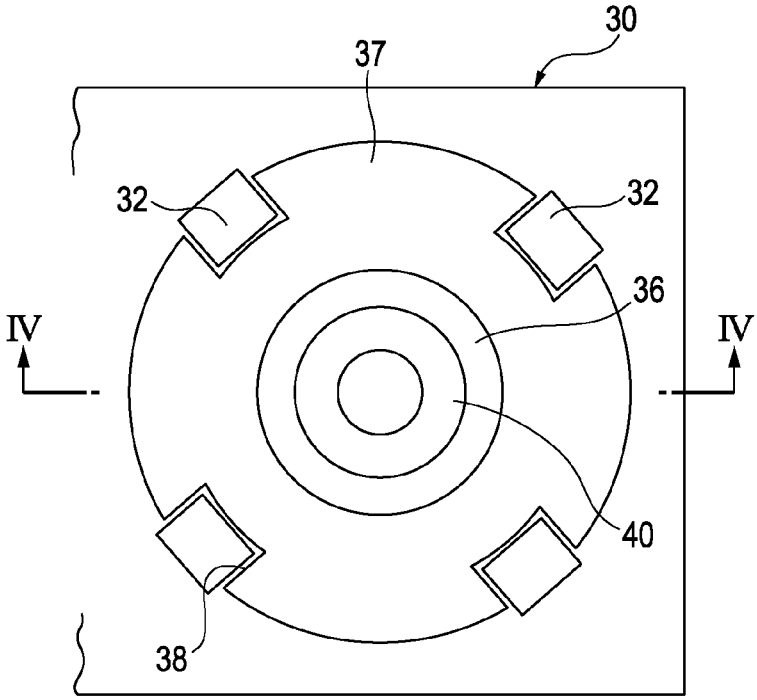
FIG. 3 is a plan view of a supply pipe connecting portion.
Figure 4:
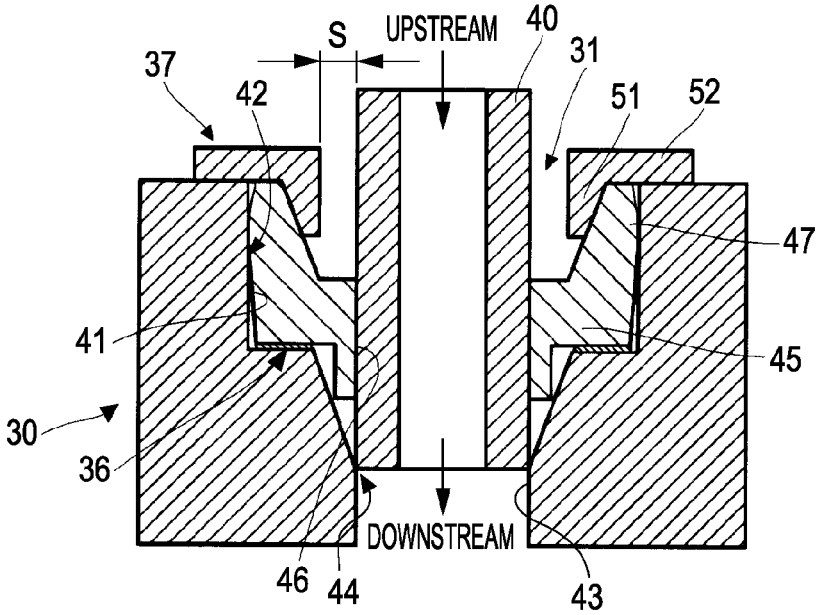
FIG. 4 is a sectional view of the supply pipe connecting portion in FIG. 3.

FIG. 1 schematically shows the general configuration of an ink jet recording apparatus to which a flow path member according to an exemplary embodiment of the invention is adapted. FIG. 2 is a perspective view of the main portions of an ink ejecting head, FIG. 3 is a plan view of a portion of a holder to which a supply pipe is connected, and FIG. 4 is a sectional view of the portion of the holder (along line IV-IV in FIG. 3).

Referring to FIG. 1, the ink jet recording apparatus will be described.

As shown in FIG. 1, the ink jet recording apparatus 1 as a liquid ejecting apparatus has a carriage 3 on which ink cartridges 2 are mounted, and an ink ejecting head 5 as a liquid ejecting head attached to the carriage 3. The carriage 3 is connected to a stepping motor 7 via a timing belt 6, and is guided by a guide bar 8 to make reciprocal movement across a recording sheet 9 or in a widthwise direction thereof (main scanning direction). The carriage 3 has a box shape with an open top, so that the ink ejecting head 5 is mounted on a side (bottom surface) of the carriage 3 facing the recording sheet 9 with the nozzle surface of the ink ejecting head 5 exposed, and the ink cartridges 2 are accommodated in the carriage 3.

Inks are supplied to the ink ejecting head 5 from the ink cartridges 2, and ink droplets are ejected onto the top surface of the recording sheet 9 to print an image and characters on the recording sheet 9 in dot matrix while the carriage 3 is move. Referring to FIG. 1, a cap 10 seals the nozzle opening of the ink ejecting head 5 when printing does not take place to thereby prevent the nozzle from drying, and applies negative pressure onto the nozzle surface of the ink ejecting head 5 to perform a cleaning operation. A wiper blade 11 wipes out the nozzle surface of the ink ejecting head 5. A waste ink retainer 12 retains waste ink sucked in the cleaning operation. A control unit 13 controls the ink jet recording apparatus 1.

The illustrated ink ejecting head 5 includes a flow-path forming member where flow paths for supplying inks from the ink cartridges 2 are formed. Although FIG. 1 illustrates an example where the ink cartridges 2 as fluid sources are mounted in the carriage 3, the invention can be adapted to an ink jet recording apparatus structured such that the ink cartridges are accommodated at another location separate from the carriage 3, and inks are supplied to the flow-path forming member of the ink ejecting head 5 via a pipe under pressure.

The ink ejecting head 5 will be described referring to FIG. 2.

As shown in FIG. 2, the ink ejecting head 5 includes a pressure generating unit, such as a piezoelectric element, to eject ink droplets from the nozzle opening of a nozzle plate 15 using the pressure generated by the displacement of the piezoelectric element. The ink ejecting head 5 is provided with a reservoir chamber, and a flow-path forming member 21 having the flow path member according to the invention is connected to the top portion of the ink ejecting head 5. Ink as a fluid from the flow-path forming member 21 is supplied to a head flow path of the ink ejecting head 5 and supplied to the reservoir chamber from the head flow path. Inks are supplied to the flow-path forming member 21 from the ink cartridges 2. For example, the inks are supplied to the flow-path forming member 21 from the ink cartridges 2 via a supply pipe or an ink supply probe.

Referring to FIGS. 2 and 3, the flow-path forming member 21 will be described below.

As shown in FIG. 2, the flow-path forming member 21 has the shape of a rectangular parallelepiped block having rectangular faces. Films are welded to both faces of a body 22 of a resin to form flow paths 24 on the respective faces. An outlet flow path 25 is provided contiguous to the lower portion of the flow path 24. The outlet flow path 25 is formed to become wider toward the downstream side (lower side). A filter 27 is provided inside the outlet flow path 25. The filter 27 is disposed on a wide portion of the face with an area substantially corresponding to the wide outlet flow path 25, thereby securing a large area. The filter 27 mainly traps a foreign matter contained in ink flowing through a valve body 34 (mechanical component) to be described later.

The ink which passes through the flow path 24 is supplied to a lower portion inside the body 22 through the filter 27 from outside the face, and is supplied to the ink ejecting head 5 from a discharge hole (not shown). That is, the ink which passes through the flow path 24 to be supplied to the outlet flow path 25 moves from a narrow flow path to a wider flow path, and passes through the filter 27 to be supplied to one reservoir chamber of the ink ejecting head 5 from the discharge hole at an end.

Flow-in path sections 30 as holders (resin holders) for flow path members are provided at upper ends of the flow-path forming member 21. Ink inlet holes 31 are respectively provided at the flow-in path sections 30, and inks are respectively supplied to the ink inlet holes 31 from the ink cartridges 2. The ink that is supplied to one ink inlet hole 31 (on the left-hand side in FIG. 2) is supplied to the inlet side of the flow path 24 shown in FIG. 2, and the ink that is supplied to the other ink inlet hole (on the right-hand side in FIG. 2) is supplied to the inlet portion of a flow path provided on the other side of the flow-path forming member 21 (on the bottom side of the sheet of FIG. 2).

The ink that is supplied to the ink inlet hole 31 is supplied to an ink chamber 33. Valve bodies 34 as opening/closing members are respectively provided in flow paths between the ink inlet holes 31 and the ink chambers 33. The valve body 34 operates to permit circulation of ink when pressure in the reservoir chamber of the ink ejecting head 5 drops, i.e., when the pressure in the flow path 24 relatively drops as a result of ejection of ink.

That is, in the case where ink is supplied from the ink inlet hole 31 under predetermined pressure, the valve body 34 is closed when the ink is retained in the reservoir chamber of the ink ejecting head 5, and is opened by negative pressure to supply the ink when the downstream-side pressure drops due to ejection of the ink.

As shown in FIGS. 2 and 3, a seal member 36 as an elastic urging member is fixed to the ink inlet hole 31 of the flow-in path section 30 by a fixing member 37, and an ink supply pipe 40 as a fluid supply pipe for supplying ink supplied from an ink supply probe or the like is urged and held on the seal member 36. The seal member 36 is inserted into ink inlet hole 31 to abut on the inner wall of the ink inlet hole 31. Then, the fixing member 37 abuts on the inner wall of the seal member 36, so that notched portions 38 of the fixing member 37 are fitted over projections 32 of the ink inlet hole 31 to be securely caulked. As a result, the seal member 36 is fitted into the inner wall of the ink inlet hole 31 to be fixed by the fixing member 37.

Referring to FIG. 4, the flow-in path section 30 (holder) of the flow-path forming member 21 will be described specifically.

As shown in FIG. 4, the ink inlet hole 31 is formed in the flow-in path section 30. The inlet portion (upstream) of the ink inlet hole 31 serves as a first opening 42 defined by a first inner wall 41, and the downstream portion (downstream) of the ink inlet hole 31 serves as a second opening 44 defined by a second inner wall 43 contiguous to the first inner wall 41. The second opening 44 is smaller in diameter than the first opening 42. The ink inlet hole 31 is formed as a continuous hole extending from the first opening 42 to the second opening 44.

The seal member 36 is fixed to the portion of the first opening 42. The seal member 36 includes a holding section 45 urging and holding the outer periphery of the ink supply pipe 40. The ink supply pipe 40 is fitted into a holding hole 46 of the holding section 45 to be held by the holding section 45. A cylindrical edge portion 47 is formed on the upper side of and contiguous to the outer periphery of the holding section 45 with a clearance provided between the edge portion 47 and the ink supply pipe 40. The edge portion 47 is fitted into the first inner wall 41 of the first opening 42, so that the outer surface of the edge portion 47 abuts on the first inner wall 41.

The edge portion 47 is held by the fixing member 37 to be secured between the first inner wall 41 of the first opening 42 and the fixing member 37. That is, the fixing member 37 includes a cylindrical part 51 abutting on the inner wall of the edge portion 47. A collar 52 which abuts on the top surface of the flow-in path section 30 and has the aforementioned notched portions 38 (see FIGS. 2 and 3) formed therein is provided on the upper side of the cylindrical part 51. The notched portions 38 (see FIGS. 2 and 3) of the collar 52 are fitted over the projections 32 (see FIGS. 2 and 3) of the ink inlet hole 31 to be securely caulked, and the edge portion 47 of the seal member 36 is held by the cylindrical part 51 to be fixed between the first inner wall 41 of the first opening 42 and the cylindrical part 51.

A clearance S is provided in the first opening 42 between the cylindrical part 51 holding the edge portion 47 and the ink supply pipe 40. In other words, the first opening 42 defined by the first inner wall 41 is formed in such a way as to form the clearance S between the cylindrical part 51 and the ink supply pipe 40.

Accordingly, the fixing member 37 (cylindrical part 51) does not interfere with the ink supply pipe 40, and the members on the upstream side and the downstream side of the ink supply pipe 40 are not misaligned with each other. Further, it is possible to keep the ink supply pipe 40 fitted into the holding hole 46 of the holding section 45, thus preventing a clearance from being formed between the ink supply pipe 40 and the holding hole 46. Furthermore, the edge portion 47 can be reliably held by the cylindrical part 51 between the first inner wall 41 and the cylindrical part 51.

Although the seal member 36 and the fixing member 37 are formed as separate members according to the embodiment, they may be formed integrally. In this case, for example, the seal member 36 and the fixing member 37 are integrally formed (integrated) of different materials to be a composite member by coinjection molding. With the seal member 36 and the fixing member 37 integrated, the seal member 36 can be attached to the flow-in path section 30 by welding the fixing member 37 of the composite member to the flow-in path section 30 (holder) at the top surface portion of the first opening 42. Accordingly, just the step of attaching the composite member (single step) allows the holding section 45 of the seal member 36 to be disposed inside the first inner wall 41 and allows the edge portion 47 of the seal member 36 to be pressed against and firmly in contact with the first inner wall 41.

The aforementioned structure of the flow-in path section 30 causes the edge portion 47 of the seal member 36 to be firmly in contact with the first inner wall 41 of the first opening 42 by the fixing member 37, so that the ink supply pipe 40 is urged and held into the holding hole 46 of the holding section 45 of the seal member 36 in a predetermined position with respect to the first inner wall 41 of the first opening 42 and the second inner wall 43 of the second opening 44. This causes the ink supply pipe 40 to be held in a predetermined position of the ink inlet hole 31 with the first opening 42 of the flow-in path section 30 kept airtight.

Even when the pressure on the upstream side of the ink supply pipe 40 and the pressure on the second opening 44 side relatively vary, the ink supply pipe 40 and the flow-in path section 30 (ink inlet hole 31) which are to be connected to each other are therefore kept airtight. That is, even when the valve body 34 (see FIG. 2) is open/closed by a variation in pressure due to emission of ink and pressure on the upstream side and pressure on the down stream side vary, airtightness of the ink supply pipe 40 and the flow-in path section 30 (ink inlet hole 31) that are the members to be connected together can be maintained.

When the pressure on the second opening 44 side relatively drops, for example, force acts on the seal member 36 side where the edge portion 47 of the seal member 36 is firmly in contact with the first inner wall 41 of the first opening 42 to secure the airtight condition. When the pressure on the second opening 44 side relatively rises, however, force acts on the seal member 36 side toward the interior of the first opening 42 (opposite side to the first inner wall 41) such that clearance is formed between the edge portion 47 and the first inner wall 41. The aforementioned structure of the flow-in path section 30 maintains the tight contact of the edge portion 47 of the seal member 36 with the first inner wall 41 by the fixing member 37, keeping the airtight state even when the pressure on the second opening 44 side relatively rises.

In addition, the ink supply pipe 40 is urged and held on the holding section 45 of the seal member 36, and the edge portion 47 of the seal member 36 is firmly in contact with the first inner wall 41 by the fixing member 37, so that a single seal member 36 can be provided with two functions of achieving tight contact with the ink supply pipe 40 and tight contact with the first inner wall 41. This makes it possible to keep the sealing of the first opening 42 with the ink supply pipe 40 held without increasing the rigidity of the seal member 36.

The flow-in path section 30 can maintain airtightness of the members to be connected together (ink supply pipe 40 and ink inlet hole 31) with a simplified structure, regardless of a variation in pressure in the flow path or the like. Further, the ink ejecting head 5 and the ink jet recording apparatus 1 can be provided with the flow-in path section 30 that can keep airtightness of the members to be connected together (ink supply pipe 40 and ink inlet hole 31) with a simplified structure, regardless of a variation in pressure in the flow path or the like.

Although the foregoing description of the embodiment has been given of an exemplary flow path member that connects the ink supply pipe 40 to the flow-path forming member 21, the invention may be applied to a flow path member where ink flow paths (fluid flow paths) are formed on a separate member. Although the ink jet recording head has been described as an example of the liquid ejecting head, the invention is directed toward a variety of liquid ejecting heads, and may of course be applied to a liquid ejecting head which ejects a fluid other than ink. Examples of other liquid ejecting heads include various recording heads used in image recording apparatus, such as a printer, a color-material ejecting head used in manufacturing color filters for a liquid crystal display or the like, an electrode-material ejecting head used in forming electrodes of an organic EL display, FED (Field Emission Display) or the like, and a bio organic-substance ejecting head used in manufacturing bio chips.

What is claimed is:

1. A flow path member comprising:

an elastic urging member that urges and holds a fluid supply pipe having a supply path that supplies a fluid downstream;

a holder having a first inner wall that defines a first opening and on which an outer wall of the elastic urging member abuts, and a second inner wall that defines a second opening smaller than the first opening, the fluid supply pipe being disposed inward of the first inner wall and the second inner wall with the outer wall of the elastic urging member held against the first inner wall; and a fixing member that abuts on an inner wall of the elastic urging member to hold the elastic urging member between the fixing member and the first inner wall of the holder, wherein the elastic urging member includes a holding section that holds the fluid supply pipe, and an edge portion formed contiguous to the holding section with a clearance provided between the edge portion and the fluid supply pipe held by the holding section, and the fixing member abuts on an inner wall of the edge portion to hold the elastic urging member between the fixing member and the first inner wall of the holder.

2. The flow path member according to claim 1, wherein a clearance is provided between the fluid supply pipe and a portion of the fixing member that holds the elastic urging member in the first opening.

3. A liquid ejecting head comprising:

the flow path member according to claim 2; and a head body connected to a downstream side of the holder of the flow path member and having a nozzle opening.

4. A liquid ejecting apparatus comprising:

the liquid ejecting head according to claim 3; and a fluid source connected to an upstream side of the fluid supply pipe held by the elastic urging member of the flow path member.

5. A liquid ejecting apparatus comprising:

the liquid ejecting head according to claim 2; and a fluid source connected to an upstream side of the fluid supply pipe held by the elastic urging member of the flow path member.

6. The flow path member according to claim 1, wherein the elastic urging member and the fixing member are formed integrally.

7. A liquid ejecting head comprising:

the flow path member according to claim 6; and a head body connected to a downstream side of the holder of the flow path member and having a nozzle opening.

8. A liquid ejecting apparatus comprising:

the liquid ejecting head according to claim 7; and a fluid source connected to an upstream side of the fluid supply pipe held by the elastic urging member of the flow path member.

9. A liquid ejecting head comprising:

the flow path member according to claim 1; and a head body connected to a downstream side of the holder of the flow path member and having a nozzle opening.

10. A liquid ejecting apparatus comprising:

the liquid ejecting head according to claim 9; and a fluid source connected to an upstream side of the fluid supply pipe held by the elastic urging member of the flow path member.

11. A flow path member comprising:

an elastic urging member that urges and holds a fluid supply pipe having a supply path that supplies a fluid downstream;

a holder having a first inner wall that defines a first opening and on which an outer wall of the elastic urging member abuts, and a second inner wall that defines a second opening smaller than the first opening, the fluid supply pipe being disposed inward of the first inner wall and the second inner wall with the outer wall of the elastic urging member held against the first inner wall; and a fixing member that abuts on an inner wall of the elastic urging member to hold the elastic urging member between the fixing member and the first inner wall of the holder ejection head, wherein a liquid supplied from the fluid supply pipe urged and held by the elastic urging member is supplied to a head body, and wherein the head body is provided with an opening/closing member that opens and closes a flow path between the head body and the second opening in accordance with pressure in a flow path in the head body.

12. A liquid ejecting head comprising:

the flow path member according to claim 11; and a head body connected to a downstream side of the holder of the flow path member and having a nozzle opening.

13. A liquid ejecting apparatus comprising:

the liquid ejecting head according to claim 12; and a fluid source connected to an upstream side of the fluid supply pipe held by the elastic urging member of the flow path member.

* * * * *